US006401479B2

(12) United States Patent
Garrett

(10) Patent No.: US 6,401,479 B2
(45) Date of Patent: Jun. 11, 2002

(54) CONTAINERS FOR PERISHABLE PRODUCE

(75) Inventor: Michael Ernest Garrett, Woking (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 09/731,209

(22) Filed: Dec. 6, 2000

(30) Foreign Application Priority Data

Dec. 8, 1999 (GB) ..... 9929047

(51) Int. Cl.[7] ..... F25D 3/08
(52) U.S. Cl. ..... 62/371; 62/457.9; 62/384
(58) Field of Search ..... 62/371, 457.9, 62/384

(56) References Cited

U.S. PATENT DOCUMENTS

| | | | | |
|---|---|---|---|---|
| 3,974,658 A | * | 8/1976 | Starrett | 62/60 |
| 4,017,252 A | | 4/1977 | Tallonneau | |
| 5,586,438 A | * | 12/1996 | Fahy | 62/78 |
| 5,729,983 A | | 3/1998 | Garrett et al. | |
| 6,065,294 A | * | 5/2000 | Hammerstedt et al. | 62/3.3 |
| 6,209,343 B1 | * | 4/2001 | Owen | 62/457.3 |
| 6,209,344 B1 | * | 4/2001 | Mahajan | 62/457.3 |
| 6,220,051 B1 | * | 4/2001 | Takasugi | 62/530 |
| 6,230,515 B1 | * | 5/2001 | Wiesman | 62/457.1 |

FOREIGN PATENT DOCUMENTS

| | | |
|---|---|---|
| DE | 197 04 968 A1 | 7/1998 |
| EP | 1 028 283 A2 | 8/2000 |
| EP | 1 055 470 A1 | 11/2000 |
| GB | 2 311 121 A | 9/1997 |

* cited by examiner

*Primary Examiner*—William Doerrler
*Assistant Examiner*—Mark Shulman
(74) *Attorney, Agent, or Firm*—Joshua L. Cohen; Salvatore P. Pace

(57) ABSTRACT

A container for cooling/refrigerating produce comprising at least one panel made from metal foam for storing a cryogenic fluid under pressure and means for discharging said fluid into the container in order to reduce/maintain the temperature within the container.

8 Claims, 1 Drawing Sheet

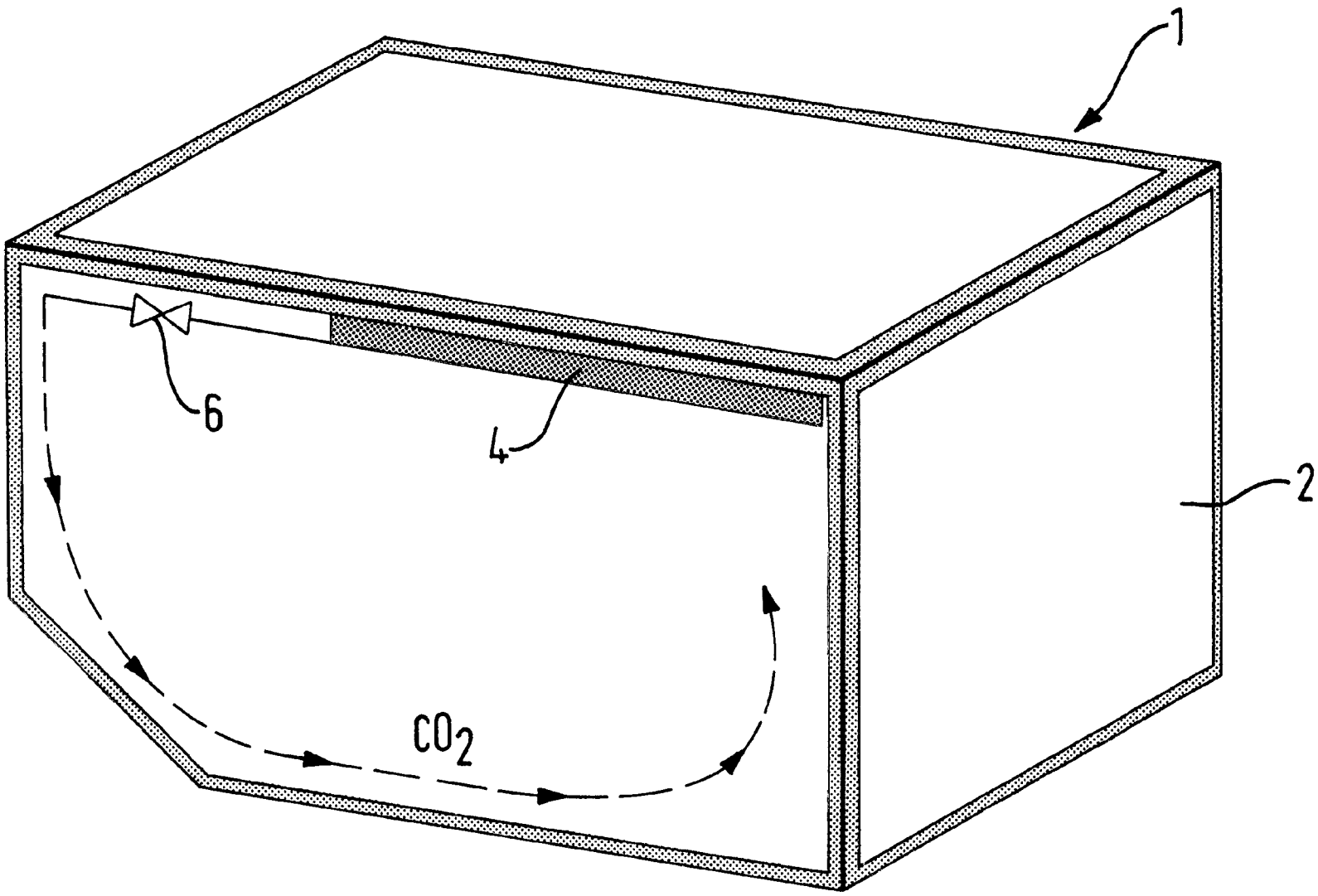
1
2
4
6
$CO_2$

CONTAINERS FOR PERISHABLE PRODUCE

FIELD OF THE INVENTION

The present invention relates to containers for cooling/refrigerating perishable goods and particularly but not exclusively to containers for maintaining the temperature of perishable goods in transit.

BACKGROUND OF THE INVENTION

Known cryogenic refrigeration systems for transporting perishable food stuff comprise heavily insulated liquid storage tanks which are capable of holding liquid cryogen at several atmospheres pressure. Usually, a distribution system is provided which utilises the pressure within the storage tank to generate a spray of cryogen within a container to reduce the temperature within the container and that of any perishable goods therein. These systems are common in vehicular refrigerated traitors, or "reefers" either instead of or in combination with a mechanical refrigeration unit.

Containers are also used to transport produce which are designed to fit an aircraft hold. One such container makes use of dry ice stored within the container coupled with a battery driven fan which provides a degree of temperature control for the produce in transit. However, this solution to the transit of perishable goods by air is wasteful since much of the heat available from the liquid carbon dioxide is lost in transforming to dry ice and the dry ice itself continues to evaporate because of heat leak thereby needing to be renewed frequently.

It is an aim of the present invention to provide a container for cooling/refrigerating produce without the need for an external power source.

SUMMARY OF THE INVENTION

According to the present invention, a container for cooling/refrigerating produce comprises at least one panel made from metal foam for storing a cryogenic fluid under pressure and means for discharging said fluid into the container in order to reduce/maintain the temperature within the container.

Preferably the cryogenic fluid is liquid carbon dioxide and a valve is provided within the container, the operation of which valve controls the discharge of the liquid carbon dioxide according to the temperature within the container.

Preferably the valve is actuated by means of a signal from a temperature sensor located within the container.

In a preferred embodiment the container is provided with an envelope or cover of insulating material.

BRIEF DESCRIPTION OF THE INVENTION

An embodiment of the invention will now be described by way of example reference being made to the FIGURE of the accompanying diagramatic drawing which is a perspective cross-section through a container according to the present invention.

DETAILED DESCRIPTION OF THE INVENTION

As shown a container 1 suitable for transporting perishable goods by air comprises an outer envelope 2 of insulating material which is lined with at least one panel 4 of metal foam. The metal foam may be aluminium metal foam having a continuously connected, open celled (reticulated) geometry which acts as a high pressure gas container or as a reservoir for liquid carbon dioxide under pressure.

In use, perishable produce is loaded within the container 1 and the container 1 is then for example loaded into the fuselage of a transporting aircraft. A temperature sensor (not shown) within the container is set such that if the temperature within the container rises above a predetermined value, a valve 6 is opened allowing the liquid carbon dioxide to spray into the upper part (as shown) of the container 1. This fine spray turns into a stream of very cold gas and also some carbon dioxide snow which is dispersed about the perishable produce.

As the container 1 cools the temperature sensor shuts off the valve 6 and hence the supply of carbon dioxide thereby effecting temperature control within the container 1.

This operation will continue until the liquid carbon dioxide is exhausted but because of the metal foam gas containment a large amount of liquid carbon dioxide can be carried in several flat panels of rectangular or curved shape approximately 1 inch (2.5 cm) thick. The container 1 as described can always be used for temperature control and the liquid carbon dioxide is easily replaced whereupon the container 1 again becomes ready for use when required.

I claim:

1. An integrated container for cooling/refrigerating produce comprising at least one panel made from metal foam for storing a cryogenic fluid under pressure and means for discharging said fluid into the container in order to reduce/maintain the temperature within the container.

2. The container as claimed in claim 1, in which the cryogenic fluid is liquid carbon dioxide under pressure.

3. The container as claimed in claim 1 in which a valve is provided within the container, the operation of which valve controls the discharge of the cryogenic fluid according to the temperature within the container.

4. The container as claimed in claim 3 in which the valve is actuated by a signal from a temperature sensor located within the container.

5. The container as claimed in claim 1 in which an envelope of insulating material surrounds said container.

6. The container as claimed in claim 1 wherein said produce is perishable goods.

7. The container as claimed in claim 1 wherein said metal foam is aluminium metal foam.

8. The container as claimed in claim 1 wherein said container requires no external power supply.

* * * * *